US008220288B2

(12) United States Patent
Görz et al.

(10) Patent No.: US 8,220,288 B2
(45) Date of Patent: Jul. 17, 2012

(54) MULTI-DOOR REFRIGERATOR COMPRISING A HEATABLE DOOR BAR

(75) Inventors: Alexander Görz, Aalen (DE); Karl-Friedrich Laible, Langenau (DE); Hans-Philipp Reitz, Giengen (DE); Helmut Steichele, Lauingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 749 days.

(21) Appl. No.: 12/310,415

(22) PCT Filed: Aug. 6, 2007

(86) PCT No.: PCT/EP2007/058108

§ 371 (c)(1),
(2), (4) Date: Feb. 24, 2009

(87) PCT Pub. No.: WO2008/025642

PCT Pub. Date: Mar. 6, 2008

(65) Prior Publication Data

US 2009/0320509 A1 Dec. 31, 2009

(30) Foreign Application Priority Data

Aug. 29, 2006 (DE) ..... 20 2006 013 233 U

(51) Int. Cl.
*F25D 11/00* (2006.01)

(52) U.S. Cl. ..... 62/440; 62/275

(58) Field of Classification Search ..... 62/264, 62/275, 440, 449
See application file for complete search history.

(56) References Cited

U.S. PATENT DOCUMENTS

| | | | | |
|---|---|---|---|---|
| 2,441,080 | A | 5/1948 | Peglow | |
| 6,138,341 | A * | 10/2000 | Barroero et al. | 29/527.1 |
| 6,408,636 | B1 | 6/2002 | Backes et al. | |
| 7,043,886 | B1 * | 5/2006 | Chubb | 52/656.4 |

FOREIGN PATENT DOCUMENTS

| | | |
|---|---|---|
| DE | 3505759 A1 | 8/1985 |
| GB | 857999 | 1/1961 |
| WO | 2006120078 A1 | 11/2006 |

* cited by examiner

*Primary Examiner* — Melvin Jones
(74) *Attorney, Agent, or Firm* — James E. Howard; Andre Pallapies

(57) ABSTRACT

A refrigerator including a body unit and a pair of doors which are attached on opposite sides of the body unit and which jointly delimit a first internal space, wherein a first door of said pair supports a bar that extends into the internal space when the first door is in a closed position, said bar having a locating face, against which a rear side of the second door fits closely when both doors are in a closed position, and containing an electrical heating device, the refrigerator including a control circuit for the electrical heating device including at least one electric contact through which a current supply circuit of the electrical heating device is routed, the at least one electrical contact being attached to the body unit and conductively connected to a complementary contact disposed on the first door when the first door is closed.

13 Claims, 2 Drawing Sheets

MULTI-DOOR REFRIGERATOR COMPRISING A HEATABLE DOOR BAR

BACKGROUND OF THE INVENTION

Single-door refrigerators generally have a body unit comprising a front frame and a door on whose rear side is arranged a peripheral sealing profile which fits closely against the frame in a closed position and seals an internal space of the refrigerator. In the case of a multi-door refrigerator, in which doors that are attached on opposite sides of the body unit close an identical internal space, a similar sealing effect can be achieved if the opening of the frame is divided into two by a bar, such that each of the doors can completely cover a partial opening. However, this solution is often found to be unsatisfactory because a fixed bar hinders access to the internal space. Two-door refrigerators have therefore been proposed in which the bar is mounted on a first of the doors and, when the first door is in a closed position, supplements the frame of the body unit in such a way that a sealing profile of the second door can fit closely against either the frame or the bar in an essentially continuous manner and thus satisfactorily seal the internal space. However, one problem of these refrigerators is that an external side of the bar is exposed to the flow of surrounding air via a gap between opposing edges of the two doors, with the result that air humidity condenses on the bar if suitable countermeasures are not taken.

It is normal practice to heat the frame of refrigerators in order to prevent the formation of condensed water. The heating usually takes place by means of a refrigerant duct which is installed in the body unit along the frame and is arranged in the refrigerant circuit of the refrigerator between a compressor and a condenser, and through which warm refrigerant therefore flows under high pressure. Additionally installing such a refrigerant duct in the bar which is attached to and moves with one of the doors would incur prohibitive costs, and therefore an electrical heating device is generally provided for the purpose of heating such a bar. In the case of a simple and in particular monoaxial structure of the hinge connecting door and body unit, it is not excessively difficult to route a current supply circuit of the electrical heating device via the hinge, possibly in the form of an electrical cable which runs along the hinge axis between body unit and door, or by using the hinge itself, which is usually made of metal, as an electrical conductor.

In the case of built-in appliances in particular, or more generally in the case of appliances whose doors are faced by decorative panels of any type in order that their appearance can be matched to that of adjacent furniture or appliances, more complicated hinge designs are often required in order to guide the movement of the door in such a way that the opening and closing of the door is not obstructed by adjacent decorative panels. These hinge designs generally have a plurality of axes which are movable in the course of their pivoting movement and are not suitable for the passage of a cable, and furthermore the electrical conductivity of the hinge as a whole is not always guaranteed.

BRIEF SUMMARY OF THE INVENTION

The object of the present invention is to provide a refrigerator comprising at least two doors, of which one supports a heatable bar, wherein the supply of heating current to an electrical heating device of the bar is easily and reliably established independently of the construction of the hinges connecting the doors and the body unit.

The object is achieved in that, in the case of a refrigerator comprising a body unit and a pair of doors which are attached on opposite sides of the body unit and which jointly delimit a first internal space, wherein a first of the two doors supports a bar that extends into the internal space when the first door is in a closed position, said bar having a locating face against which a rear side of the second door fits closely when both doors are in a closed position, and containing a heating device, at least one supply contact, via which a current supply circuit of the electrical heating device is routed, is attached to the body unit and is conductively connected to a complementary contact of the first door when the first door is closed.

The supply contact is advantageously assigned to an electrical component disposed in the electrical circuit of the refrigerator, e.g. a display, a control unit or an interior light or similar, or is arranged on these components.

Since these components, e.g. the internal light, must in any case be supplied with electrical energy for their operation, and a supply line is passed through the wall of the body unit for this purpose where appropriate, the heating device of the bar can easily also be supplied via this line, without it being necessary to create a passage through the wall of the body unit specially for this purpose, such a passage being awkward and costly to seal.

A second wire of the current supply circuit can be routed via a hinge which connects the first door to the body unit, if this is allowed by the construction of the hinge and the materials used for the hinge.

Alternatively, a second supply contact can preferably be arranged on the housing of the internal light, said contact being conductively connected to a further complementary contact of the first door when the first door is closed.

The internal light can be arranged for the purpose of illuminating the internal space.

Particularly effective, however, is an embodiment in which the internal light is arranged for the purpose of illuminating a second internal space.

In this case the housing of the internal light is preferably mounted on a separating wall between the first and the second internal space.

The second internal space preferably contains a drawer which can be pulled out. When it is pulled out, this drawer can be effectively and fully illuminated by the internal light even if said light is arranged right at a front edge of the separating wall and does not extend into the second internal space.

A front panel of the drawer can beneficially form a door of the second internal space.

In particular, the supply contact can be a slider which is so arranged in the housing of the internal light that it can be displaced in a manner known per se by virtue of the opening and closing of a door, in order to switch the internal light on and off depending on the open state of the door.

The complementary contact can also be displaceable and press against the first supply contact by virtue of a spring.

The bar is preferably connected to the first door in a pivoted manner, such that the first door can be opened and closed without the second door having to be opened beforehand.

BRIEF DESCRIPTION OF THE DRAWINGS

Further features and advantages of the invention may be derived from the following description of exemplary embodiments with reference to the accompanying figures, in which.

DETAILED DESCRIPTION OF THE PRESENT INVENTION

Figure 1:
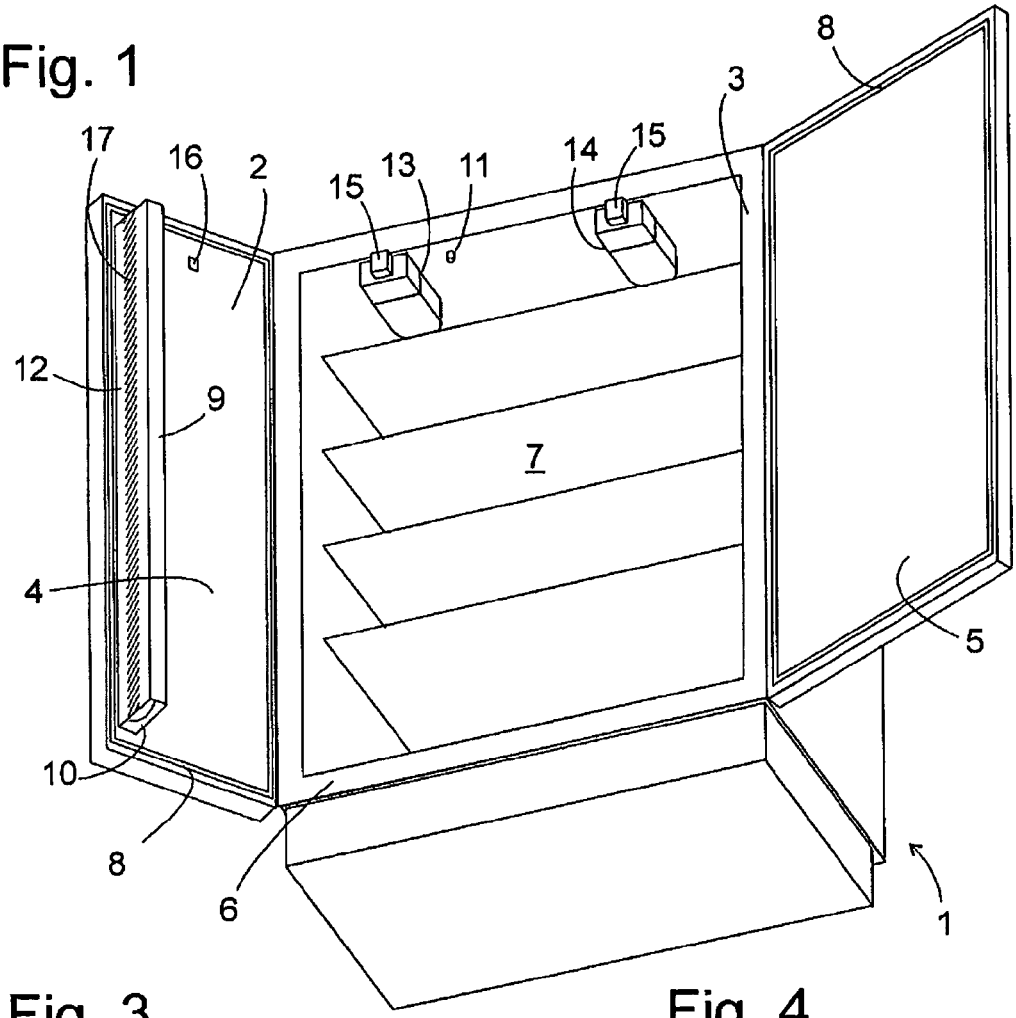
FIG. 1 shows a perspective view, obliquely from below, of a refrigerator according to a first embodiment of the invention.

FIG. 1 shows a perspective view, obliquely from below, of a refrigerator according to a first embodiment of the invention. The refrigerator has a body unit 1 to whose two side walls 2, 3 a door 4, 5 is attached in each case. The body unit 1 has a cohesive internal space 7. A plane frame 6 extends peripherally around the internal space 7 on the front side of the body unit 1.

Each of the doors 4, 5 has a frame-like peripheral magnetic sealing profile 8 on its rear side which is oriented toward the body unit 1 when the door is in a closed position. A vertical bar 9 is pivotably attached to the narrower of the two doors. The bar 9 has a guide groove 10 at the top and bottom end face in each case. The guide grooves 10 are arranged in such a way that when the door 4 is swung from the position shown in the figure into the closed position against the frame 6, guide pegs 11 which are arranged at the top and bottom of the body unit 1 project into the grooves 10 and, as a result of sliding along in said grooves, cause a pivoting movement of the bar 9 relative to the door 4. Upon completion of this pivoting movement, when the door 4 is fitting closely against the frame 6, a wide front side 12 of the bar 9 is flush with the frame 6. If the door 5 is now swung into the closed position, its sealing profile 8 comes to rest against both the frame 6 and the front side 12 of the bar 9 in a tight-fitting manner.

The pivoting movement of the bar 9, said movement being guided by the pegs 11 and grooves 10, makes it possible to open or close the door 4 even if the door 5 is closed. An internal light 13 or 14 which is arranged at the top of the body unit 1 is assigned to each door 4, 5. Each internal light 13, 14 comprises a housing whose translucent rear region which faces away from the doors 4,5 holds an illuminant such as a light bulb, LED or similar, and in whose front region a sprung slider 15 is guided. When the door is open, the tips of the sliders 15 are pushed by their springs in each case beyond the front side of the frame 6 such that they come into contact with the rear side of the doors 4, 5 and are forced back when said doors are closed. The movement of the sliders 15 actuates a switch in a manner known per se, said switch being accommodated in the housing of the internal light 13 or 14 and switching the illuminant on when the door is open and off when the door is closed. At least in the case of the internal light 13, the slider 15 consists of metal and has a low electrical voltage applied to it via its spring. If the illuminant is a low-voltage illuminant such as e.g. a halogen bulb or an LED arrangement, the supply voltage of the illuminant is advantageously applied to the slider 15. Said supply voltage can be applied continuously to the slider 15 when the door 4 is both open and closed, or provision can be made for using the switch that activates the illuminant, such that the supply voltage is applied either to the slider 15 when the door is closed or to the illuminant when the door is open. A simple two-wire supply cable which is passed through the wall of the body unit 1 therefore suffices to supply voltage to both the internal light 13 and the slider 15.

A metal contact panel 16 is arranged on the rear side of the door 4 in such a way that a conductive contact with the slider 15 is formed when the door 4 is closed. An electrical supply line that is not visible in the figure runs from this contact panel 16 through the door 4, the hinge connecting the door 4 and the bar, and the bar 9 to an electrical heating device which, as indicated by hatching in FIG. 1, extends in the form of a strip within the bar 9 and along its entire height. Said electrical heating device 17 heats the surface of the bar 9 everywhere where, when the doors 4, 5 are in a closed position, surrounding air can reach the bar 9 via a gap between opposing narrow sides of the doors 4, 5, and thus prevents the formation of condensed water or frost on the bar 9.

A second supply line which is required to close a current circuit through the heating device 17 can be routed back into the body unit 1 through a hinge that connects the door 4 to the side wall 2. Alternatively it is possible for two sliders 15 that are electrically insulated from each other to be provided on the internal light 13 and two complementary contact panels 16 to be provided on the rear side of the door 4 for the purpose of carrying the current supply circuit of the heating device 17.

Figure 2:
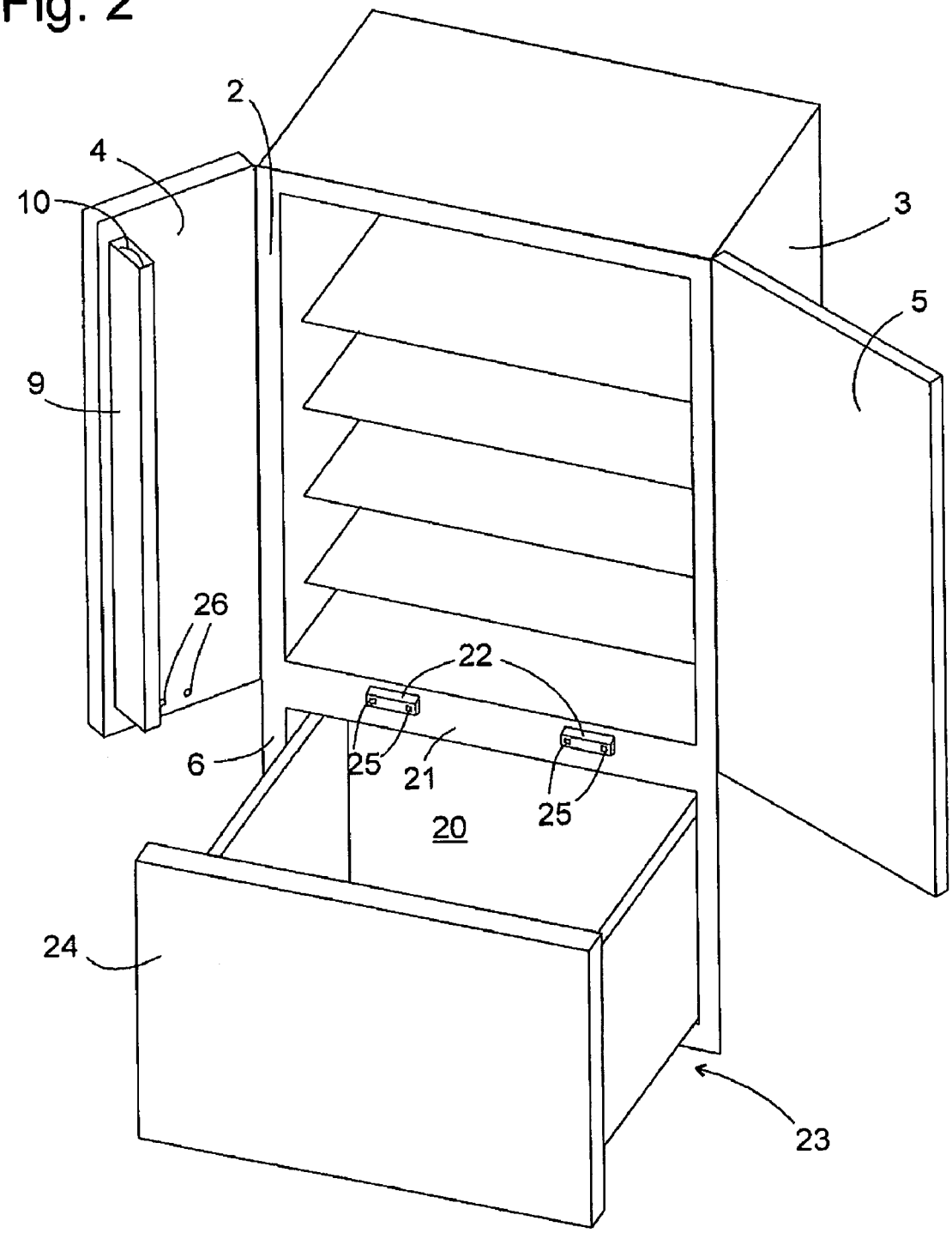
FIG. 2 shows a perspective view of a refrigerator according to a second embodiment of the invention.

A second embodiment of the invention is shown in FIG. 2 in a perspective view. Elements which are common to both this and the preceding embodiment are designated by the same reference signs. In the case of this embodiment, the body unit 1 of the refrigerator has two different internal spaces 7, 20 which are separated from each other by a horizontal intermediate wall 21. As in the case of the embodiment in FIG. 1, the upper internal space 7 can be closed by two doors 4, 5, wherein one door 4 of the two has a bar 9 attached to it and wherein sealing profiles of the doors 4, 5 fit closely against the front side 12 of said bar in a closed position. Arranged at the front edge of the intermediate wall 21 are two lighting housings 22 which are concealed by the doors 4, 5 when these are closed and, though, are provided here for the purpose of illuminating a drawer 23 which is accommodated in the lower second internal space 20. At the same time a front side of the drawer forms a third door 24 of the refrigerator. Like the doors 4, 5, this third door 24 has a peripheral sealing profile on its rear side which is not visible in the figure, said sealing profile fitting closely against the frame 6 and the intermediate wall 21 in a closed position of the door 24.

The two lighting housings 22 each have two contact panels 25 on a front side, these being connected, at least in the case of the left-hand lighting housing 22 which faces the door 4 with the bar 9, to a supply voltage for the heating device 17 of the bar 9. Two sprung contact pins 26 are located on the rear side of the door 4 such that they meet the contact panels 25 when the door 4 is closed.

Figure 3:
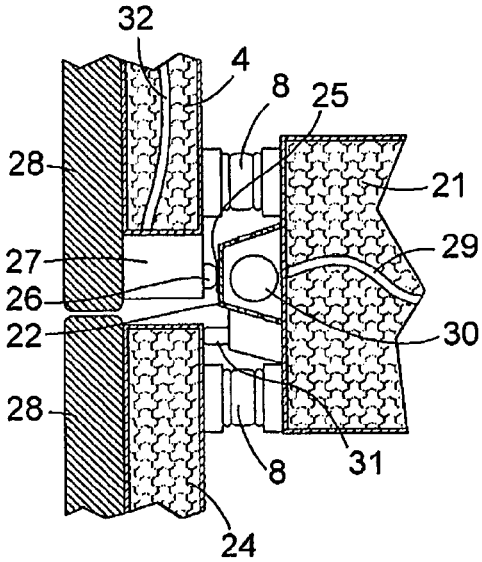
FIG. 3 shows a partial section through the refrigerator as shown in FIG. 2 with closed doors.

FIG. 3 shows a partial section through the doors 4, 24 and the intermediate wall 21 of the refrigerator which is shown in FIG. 2. The doors 4, 24 and the intermediate wall 21 are essentially realized as hollow bodies filled with insulating material; in the case of the door 4, added at the lower edge of the hollow body is a support block 27 in which the contact pins 26 are held in a displaceable manner and pressed against the contact panels 25 of the lighting housing 22 by means of springs (not shown) in order to create a conductive contact to said contact panels.

A decorative panel 28 is mounted on the external sides of the doors 4, 24 in a manner which is known per se in the case of built-in appliances.

An electrical supply cable 29 is routed through the insulation material of the intermediate wall 21 and into the lighting housing 22. The two wires of the supply cable 29 are directly connected to one of the two contact panels 25 in each case. Connected between the two wires are a low-voltage illuminant 30 and a switch, of which only the slider 31 that actuates said switch and is held in a depressed position by the door 24 can be seen. A further supply cable 32 extends from the contact pins 26 of the support block 27 through the insulation material of the door 4 to the heating device 17.

As an alternative to the illustration in FIG. 3, a switch for activating the illuminant 30 can obviously also be arranged separately from the lighting housings 22. In particular, such a switch can activate the illuminants of both lighting housings 22 simultaneously. In this case the supply cable 29 has three wires comprising a ground wire, a wire for continuously carrying the supply voltage for the heating device 17, and a switched wire which supplies the illuminant 30.

Figure 4:
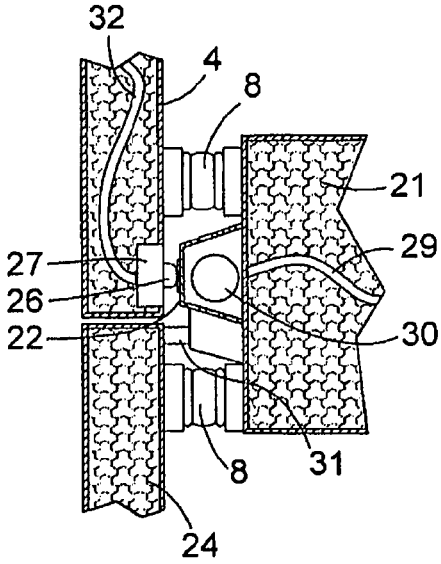
FIG. 4 shows a partial section, similar to FIG. 3, according to a modification.

In the event that the doors 4, 24 are not covered by decorative panels, but remain visible on the installed refrigerator, the support block 27 can also be embedded in the rear side of the door 4 as shown in FIG. 4, such that it is not externally visible when the door 4 is closed.

The invention claimed is:

1. A refrigerator including a body unit and a pair of doors which are attached on opposite sides of the body unit and which jointly delimit a first internal space, wherein a first door of said pair supports a bar that extends into the internal space when the first door is in a closed position, said bar having a locating face, against which a rear side of the second door fits closely when both doors are in a closed position, and containing an electrical heating device, the refrigerator comprising at least one electrical contact for the electrical heating device through which an electrical supply circuit of the electrical heating device is routed, the at least one electrical contact being attached to the body unit and conductively connected to a complementary contact disposed on the first door when the first door is closed.

2. The refrigerator according to claim 1 wherein the supply contact is operatively associated with an electrical component of the refrigerator in the electrical circuit of the refrigerator.

3. The refrigerator according to claim 2 wherein the electrical component is an internal light having a housing on which the supply contact is disposed.

4. The refrigerator according to 1 wherein the electrical supply circuit is also routed via a hinge which connects the first door to the body unit.

5. The refrigerator according to claim 1 wherein a second supply contact is disposed on the housing of the internal light and is conductively connected to a complementary contact on the first door when the first door is closed.

6. The refrigerator according to claim 1 wherein the internal light is arranged for the purpose of illuminating the first internal space.

7. The refrigerator according to claim 1 wherein the internal light is arranged for the purpose of illuminating a second internal space.

8. The refrigerator according to claim 7 wherein the housing of the internal light is mounted on a separating wall between the first and the second internal space.

9. The refrigerator according to claim 7 and further comprising a laterally movable drawer disposed in the second internal space.

10. The refrigerator according to claim 9 wherein a front panel of the drawer forms a door of the second internal space.

11. The refrigerator according to claim 1 wherein the first supply contact is formed as a slider displaceably guided in the housing of the internal light for the purpose of switching the internal light on and off.

12. The refrigerator according to claim 1 wherein the complementary contact is displaceable and is spring-biased against the first supply contact.

13. The refrigerator according to claim 1 wherein the bar is pivotably connected to the first door.

* * * * *